US009719276B2

(12) United States Patent
Guelzow et al.

(10) Patent No.: US 9,719,276 B2
(45) Date of Patent: Aug. 1, 2017

(54) PROFILE RAIL FOR LOCKER SYSTEM

(71) Applicant: WINCOR NIXDORF INTERNATIONAL GMBH, Paderborn (DE)

(72) Inventors: Peter Guelzow, Paderborn (DE); Bernhard Lutz, Delbrueck (DE); Ines Olbrisch, Solingen (DE)

(73) Assignee: WINCOR NIXDORF INTERNATIONAL GMBH, Paderborn (DE)

( * ) Notice: Subject to any disclaimer, the term of this patent is extended or adjusted under 35 U.S.C. 154(b) by 56 days.

(21) Appl. No.: 14/715,967

(22) Filed: May 19, 2015

(65) Prior Publication Data

US 2015/0345180 A1 Dec. 3, 2015

(30) Foreign Application Priority Data

Jun. 3, 2014 (EP) ..... 14170955

(51) Int. Cl.

| | |
|---|---|
| ***E05B 65/00*** | (2006.01) |
| ***E05B 65/02*** | (2006.01) |
| ***E05B 63/00*** | (2006.01) |
| ***E05B 65/52*** | (2006.01) |
| ***A47B 61/00*** | (2006.01) |
| ***A47B 96/04*** | (2006.01) |

(52) U.S. Cl.

CPC ..... *E05B 65/025* (2013.01); *A47B 61/00* (2013.01); *A47B 96/04* (2013.01); *E05B 63/00* (2013.01); *E05B 65/5215* (2013.01); *E05B 2063/0026* (2013.01)

(58) Field of Classification Search

CPC ..... A47B 61/00; A47B 94/04; E05B 63/00; E05B 65/02; E05B 65/025; E05B 65/5215

USPC ..... 312/107.5, 216, 217, 220, 265.6

See application file for complete search history.

(56) References Cited

U.S. PATENT DOCUMENTS

| | | | | |
|---|---|---|---|---|
| 1,613,731 A * | 1/1927 | Stockov | ..... | E05B 65/462 312/221 |
| 5,219,386 A | 6/1993 | Kletzmaier et al. | | |
| 6,742,854 B2 * | 6/2004 | Chen | ..... | E05B 65/463 312/217 |

(Continued)

FOREIGN PATENT DOCUMENTS

| | | |
|---|---|---|
| DE | 32 02 304 | 7/1983 |
| DE | 8 610 759 | 7/1986 |

(Continued)

OTHER PUBLICATIONS

European Search Report of Aug. 21, 2014.

*Primary Examiner* — James O Hansen
(74) *Attorney, Agent, or Firm* — Gerald E. Hespos; Matthew T. Hespos; Michael J. Porco

(57) ABSTRACT

A profile rail (1) is provided for forming a locker system (2) having a plurality of lockers (21, . . . , 26). The profile rail (1) is formed to integrate a locking mechanism (31) of one of the lockers (21) within the profile rail (1). The profile rail (1) comprises a lamella device (11) to cover the integrated locking mechanism (31; 32). The lamella device (11) is arranged to be displaceable in the direction of the longitudinal extension (L) of the profile rail (1). The lamella device (11) can be retained at a retaining site (12) of the profile rail (1) against longitudinal displacement.

14 Claims, 5 Drawing Sheets

(56) References Cited

U.S. PATENT DOCUMENTS

| | | | | |
|---|---|---|---|---|
| 6,896,342 | B1 * | 5/2005 | Cheng | E05B 65/463 312/217 |
| 2010/0026452 | A1 | 2/2010 | Wilms et al. | |
| 2014/0103785 | A1 | 4/2014 | Richards | |

FOREIGN PATENT DOCUMENTS

| | | |
|---|---|---|
| EP | 0 413 720 | 1/1994 |
| EP | 1 959 406 | 8/2008 |
| WO | 2011/014116 | 2/2011 |

* cited by examiner

PROFILE RAIL FOR LOCKER SYSTEM

BACKGROUND

1. Field of the Invention

The present invention relates to a profile rail for forming a locker system having a plurality of lockers.

2. Description of the Related Art

Locker systems, such as those found, for example, in railway stations, airports, and clothing changing rooms, or those built in the form of so-called package stations for temporary storage of shipping goods or in the form of safe systems, are gaining increasingly importance. Such locker systems have a plurality of lockers in which it is possible to (temporarily) store, for example, luggage, clothing articles, shipping goods, or values. A locker is therefore generally filled for a certain time and can be opened and emptied by an authorized party.

The lockers of such locker systems are typically lockable and, to that end, equipped with, for example, electromechanical locking mechanisms.

The reliability and robustness of these locking mechanisms are of great importance. There are essentially two approaches known from the prior art for maintaining and/or repairing locking mechanisms in the event of damage.

A first approach entails accessing the locking mechanism from the locker to which the locking mechanism is assigned. Here, the locking mechanism and typically also a corresponding wiring are directly accessible from the assigned locker. In other words, the locking mechanism is thus installed in the compartment itself. However, this approach has disadvantages, one being that it is impossible to rule out tampering with the locking mechanism by an unauthorized user of the locker. One example for preventing tampering would be to use anti-tampering screw fittings, but this is an insufficient protection. The tools required to open such screw fittings are typically procurable without great difficulty. Another disadvantage is the fact that the locking mechanism to be repaired often is no longer suitable for correctly opening a locked locker door, such that access to the locker and thus to the locking mechanism to be repaired is consequently blocked. Therefore, in the first approach described above, often a mechanical unlocking mechanism is provided, which can be used in the event of damage. However, such an emergency unlocking mechanism entails additional costs and added effort needed in manufacturing and installation.

The second approach known from the prior art entails a service access to the locking mechanism in need of repairs from outside of the locker assigned to the locking mechanism. This approach is considerably more secure against tampering. However, because locker systems often comprise a plurality of rows of compartments arranged side by side, it may be necessary to pull an entire row of compartments out from the locker system, in order to provide a service access to a locking mechanism to be repaired. It shall be readily understood that this is associated with high assembly expenses, which is why the second approach described above also comes with disadvantages.

A locker system is known, for example, from patent document EP 1 959 406 A1. Therein, the individual lockers are equipped with an electromechanical locking mechanism, and can be opened and/or closed by users of the locker system by means of a speech control unit. Another locker system is known from patent document EP 0 413 720 B1, which proposes integrating the locking mechanism of the individual lockers in each respective locker door. A similar approach is known from patent document DE 8 610 759 U1.

The purpose of the present invention is to provide a technical means with which, firstly, a locking mechanism of a locker system can be safely protected against tampering attempts and, secondly, service access to the locking mechanism can be made easily available.

SUMMARY OF THE INVENTION

A profile rail is designed to form a locker system that comprises a plurality of lockers. The "locker system" refers, for example, to a so-called packing station (also referred to as a packet station), and thus to a locker system having a plurality of lockers in which packages or similar shipping goods can be temporarily stored. The "locker system" may also instead refer to a locker system for temporary storage of luggage, articles of clothing, or valuables. The present invention is not limited to any specific locker system.

Each of the lockers of the locker system comprises a locker door that can form locking with a frame of the locker system. For this purpose, a locking mechanism is provided for each of the lockers.

The locking mechanism is configured as, for example, a lock. The term "locking mechanism" is not intended to suggest that the lockers can exclusively be locked respectively with a bolt or similar mechanical or electromechanical locking element. Rather, other locking mechanisms come into consideration, which are suitable for creating a releasable locking between the locker door on one side and the frame of the locker system.

The profile rail is configured so as to integrate such a locking mechanism of one of the lockers of the locker system within the profile rail. The profile rail, which is integrated with the locker system and in particular is not part of a locker door, thus encompasses the locking mechanism.

For coverage of the locking mechanism integrated into the profile rail, a lamella device is provided, which is arranged so as to be displaceable in the direction of the longitudinal extension of the profile rail. In addition, the lamella device can be retained at a retaining site of the profile rail against such longitudinal displacement.

In this manner, on one hand the profile rail creates a high level of security against attempts at tampering; on the other hand, it is easily possible to have a service access to a locking mechanism in the event of damage, namely by displacing the lamella device after releasing of the retention at the retaining site in the direction of the longitudinal extension of the profile rail, such that the locking mechanism integrated into the profile rail thereby is no longer covered by the lamella device and can be serviced by authorized personnel.

Hereinafter, further embodiments of the profile rail according to the invention shall be described. The additional features of these further embodiments can be combined with one another as well as with the optional features already described above, to form further embodiments, provided that they are not described explicitly as being alternative to one another.

To further increase the security against attempts at tampering, preferably, the lamella device is arranged so as to be displaceable only along the longitudinal extension of the profile rail and otherwise immovable in the profile rail, and in particular is not removable in another direction from the profile rail. Thus, if need be, the coverage of the integrated locking mechanism provided by the lamella device can be reversibly removed after the releasing of the retention of the lamella device at the retaining site and after longitudinal displacement of the lamella device along the longitudinal extension of the profile rail. The lamella device is preferably configured in such a manner, and arranged on the profile rail in such a manner, that all other attempts to remove the coverage provided by the lamella device require in destruction of the lamella device.

The retaining site for retaining the lamella device against longitudinal displacement may be arranged on the outside of the lockers of the locker system, for example, at an end part of the profile rail that extends out from a ceiling region of the locker system. For example, the lamella device is screwed to the profile rail at the retaining site of the profile rail, so that it is impossible to longitudinally displace the lamella device without first releasing the screw fitting.

The profile rail has, for example, a substantially U-shaped cross-section. For example, the profile rail has at least two profile legs and is designed so as to integrate the locking mechanism in an intervening space limited by the at least two profile legs. One of the two profile legs has, for example, an opening in order to form a locking mechanism entrance, so that a bolt can be inserted through the locking mechanism entrance into the locking mechanism, in order to form locking with the locking mechanism. The bolt (by which is also meant some other locking element, e.g., a locking clamp or hook) is arranged, for example, on a locker door. For example, a mechanical or electromechanical means is provided, which ensures that the bolt is inserted into the locking mechanism when the locker door is being locked, in order to form locking there with the locking mechanism.

The lamella device may comprise a plurality of lamella elements arranged so as to be displaceable in the direction of the longitudinal extension of the profile rail, the plurality of lamella elements preferably being configured for an at least partially mutually overlapping arrangement, in order to create a substantially opening-free side cover of the profile rail.

For this purpose, the profile rail comprises, for example, a guiding means such as a guide groove, so that the individual lamella elements of the lamella device can be displaced along the longitudinal extension of the profile rail.

The lamella elements of the lamella device may be arranged in such a manner in the profile rail that they can indeed be displaced along the longitudinal extension of the profile rail but cannot be removed laterally from the profile.

To create the substantially opening-free side cover of the profile rail, it would be appropriate for the lamella elements to be so configured and so arranged in the profile rail that they can overlap at the contact surfaces thereof. Upon failure of the locking mechanism integrated in the profile rail, the retention of the lamella device on the profile rail at the retaining site is released by authorized service personnel, so that the individual lamella elements can be displaced, for example, a distance that corresponds to the height of one individual lamella elements, so as to create access to the failing locking mechanism.

The profile rail may be configured so as to form a part of a side wall of the locker system. The side wall subdivides the locker system into a first region and a second region. The first region comprises at least a first locker and the second region comprises a second locker that is arranged horizontally adjacent to the first locker.

Thus, for example, the first region of the locker system may comprise a plurality of first lockers that are arranged one above the other. The second region of the locker system, which is separated from the first region of the locker system by the aforementioned side wall, comprises, for example, a plurality of second lockers that are arranged one above the other. A respective first locker is thus horizontally adjacent to one of the second lockers. The profile rail may be configured to form a part of the side wall of the locker system, for example, in such a manner that a front side of the profile rail is formed by one of the two profile legs and forms a part of the first side of the entire locker system.

The profile rail may be configured for a vertical arrangement, i.e., in such a manner that the longitudinal extension of the profile rail lies parallel to the vertical.

Preferably, a plurality of locking mechanisms of the locker system can be integrated in the profile rail.

The integrated locking mechanism may be assigned to at least one second locker and for a substantially opening-free rear side of the profile rail to point into an inner space of this second locker. The profile rail thus provides access to a damaged locking mechanism, preferably only from an adjacent locker, but not on the inside of the locker to which the locking mechanism is assigned. The locking mechanism assigned to the second locker is thus not accessible from the second locker, because it is covered there by the substantially opening-free rear side of the profile rail. Access to the locking mechanism of the second locker can, in this embodiment, take place only through the inner space of the adjacent first locker, by displacing the lamella elements of the lamella device along the longitudinal extension of the profile rail in order to temporarily remove the coverage of the locking mechanism of the second locker. After the locking mechanism has been repaired, the lamella elements of the lamella device are displaced back so that the locking mechanism is covered by the lamella elements and is secure against attempts at tampering by a third party.

The invention further proposes a locker system having a plurality of lockers, wherein the locker system comprises a profile rail according to the first aspect of the present invention. The locker system of the second aspect of the present invention shares the advantages of the profile rail of the first aspect of the present invention. The locker system has preferred embodiments which correspond, mutatis mutandis, to the above-described embodiments of the profile rail of the first aspect of the present invention, in particular as they are defined in the dependent claims. In this respect, reference is made to the above.

As has been explained, for example, in the previous paragraph with respect to the profile rail, the locker system is configured in one embodiment such that the locking mechanism integrated in the profile rail is assigned to the at least one second locker, and that a substantially opening-free rear side of the profile rail points to an inner space of this second locker and the lamella device of the profile rail points to an inner space of the first locker. Thus, access to the locking mechanism of the first locker takes place from the inner space of the second locker that is horizontally adjacent. In another embodiment of the locker system, access to the locking mechanism of the first locker takes place from the inner space of the first locker. In this embodiment, it is thus provided that the locking mechanism integrated in the profile rail is assigned to the at least one first locker, and that a substantially opening-free rear side of the profile rail points to an inner space of the at least one second locker and the lamella device of the profile rail points to an inner space of the at least one first locker. Both variants may be implemented in one locker system.

The idea underlying the invention shall be described in greater detail with reference to the embodiments illustrated in the drawings.

DETAILED DESCRIPTION

Figure 1:
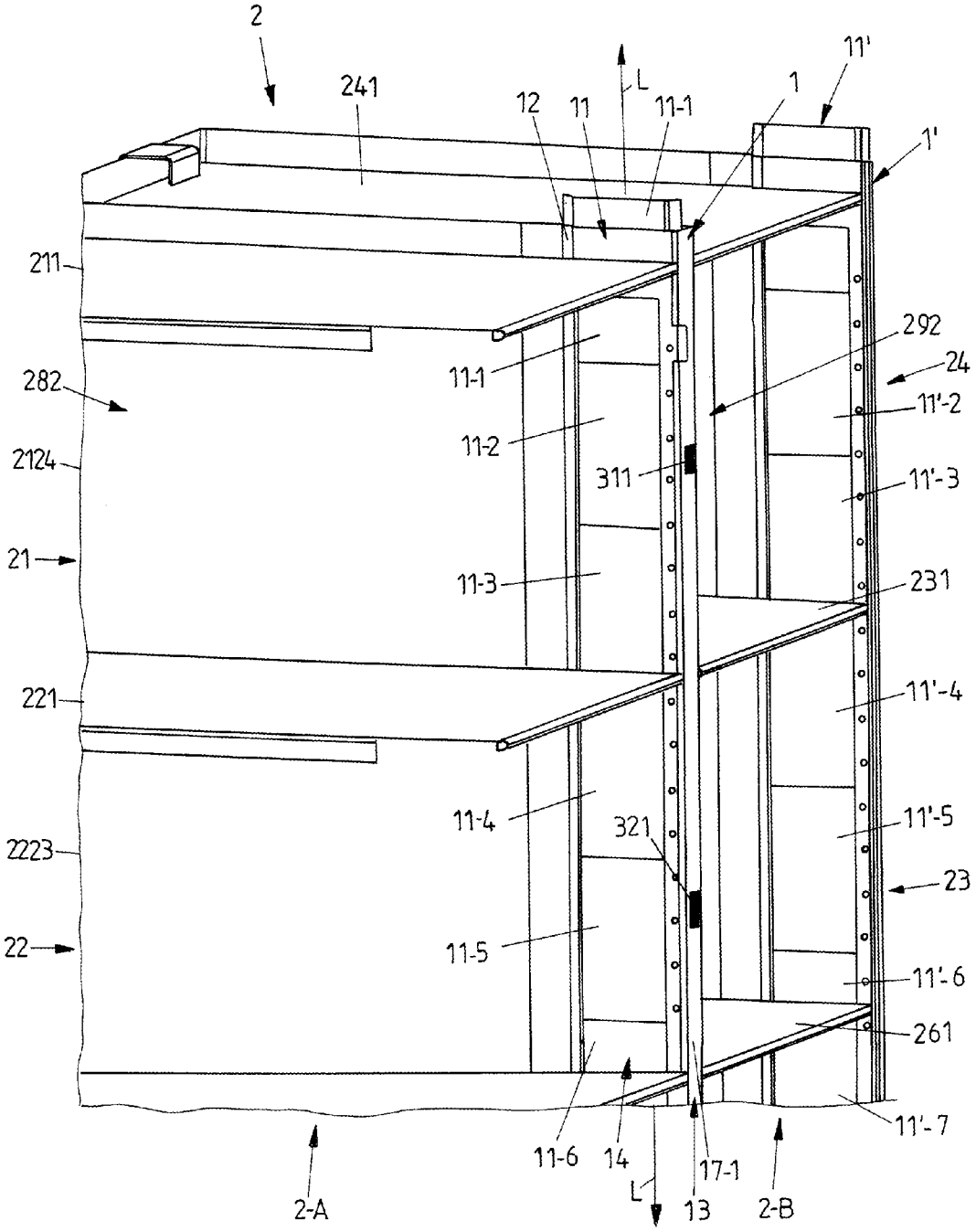
FIG. 1 illustrates a perspective and schematic view of an exemplary locker system having an exemplary profile rail having lamella elements that have not been displaced.

FIG. 1 illustrates a perspective and schematic view of an exemplary locker system 2 having two exemplary profile rails 1 and 1'. The profile rails 1 and 1' are constructed so as to be essentially identical to one another; the following description refers solely to the profile rail 1. What is said in regard to the profile rail 1 applies mutatis mutandis to the profile rail 1', as well.

The profile rail comprises a lamella device 11, which has a plurality of lamella elements 11-1 to 11-6. The profile rail 1' likewise comprises a lamella device 11', which has a plurality of lamella elements 11'-1 to 11'-7.

Figure 2:
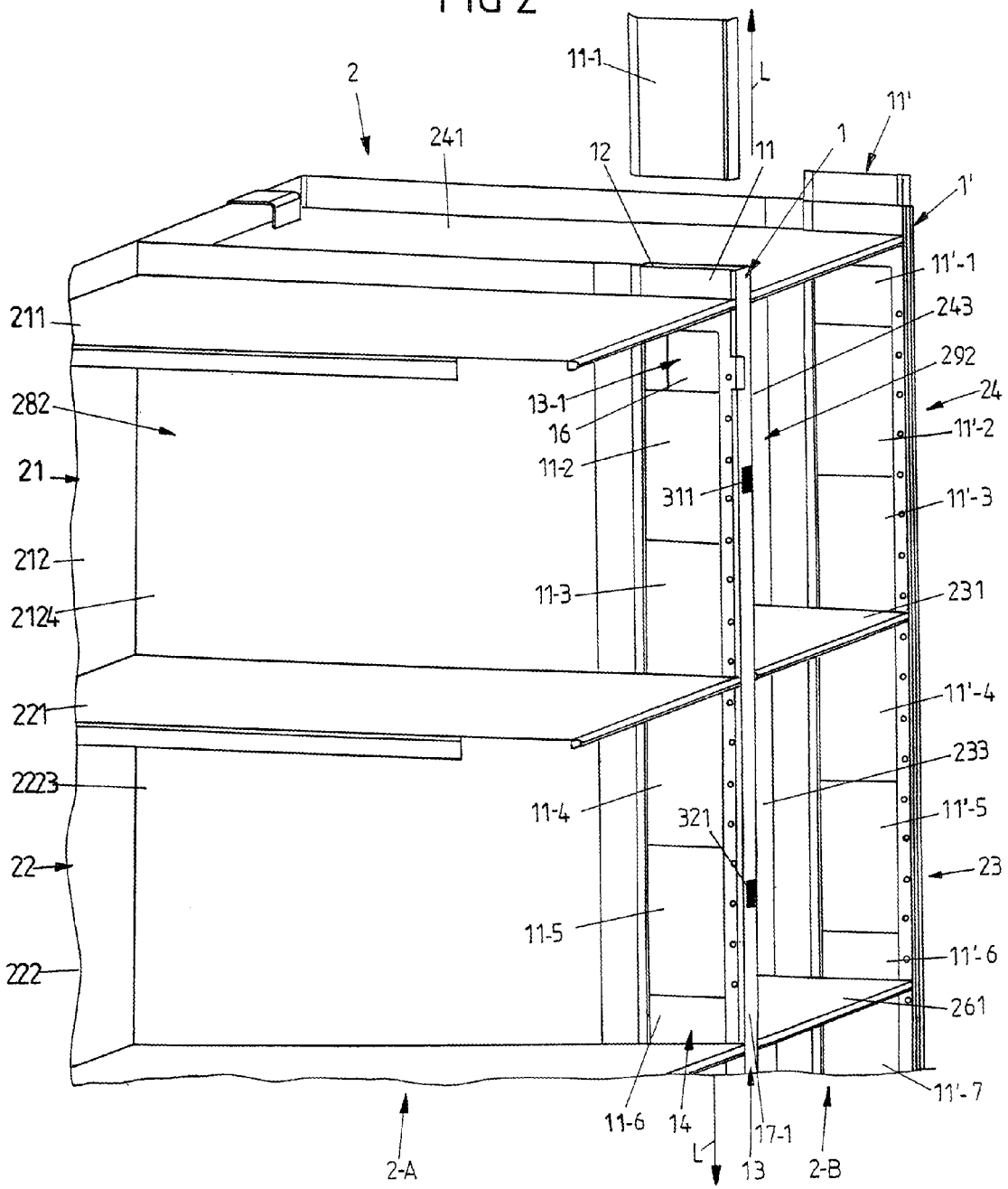
FIG. 2 illustrates a perspective and schematic view of the locker system, wherein a first lamella element has been displaced.
Figure 3:
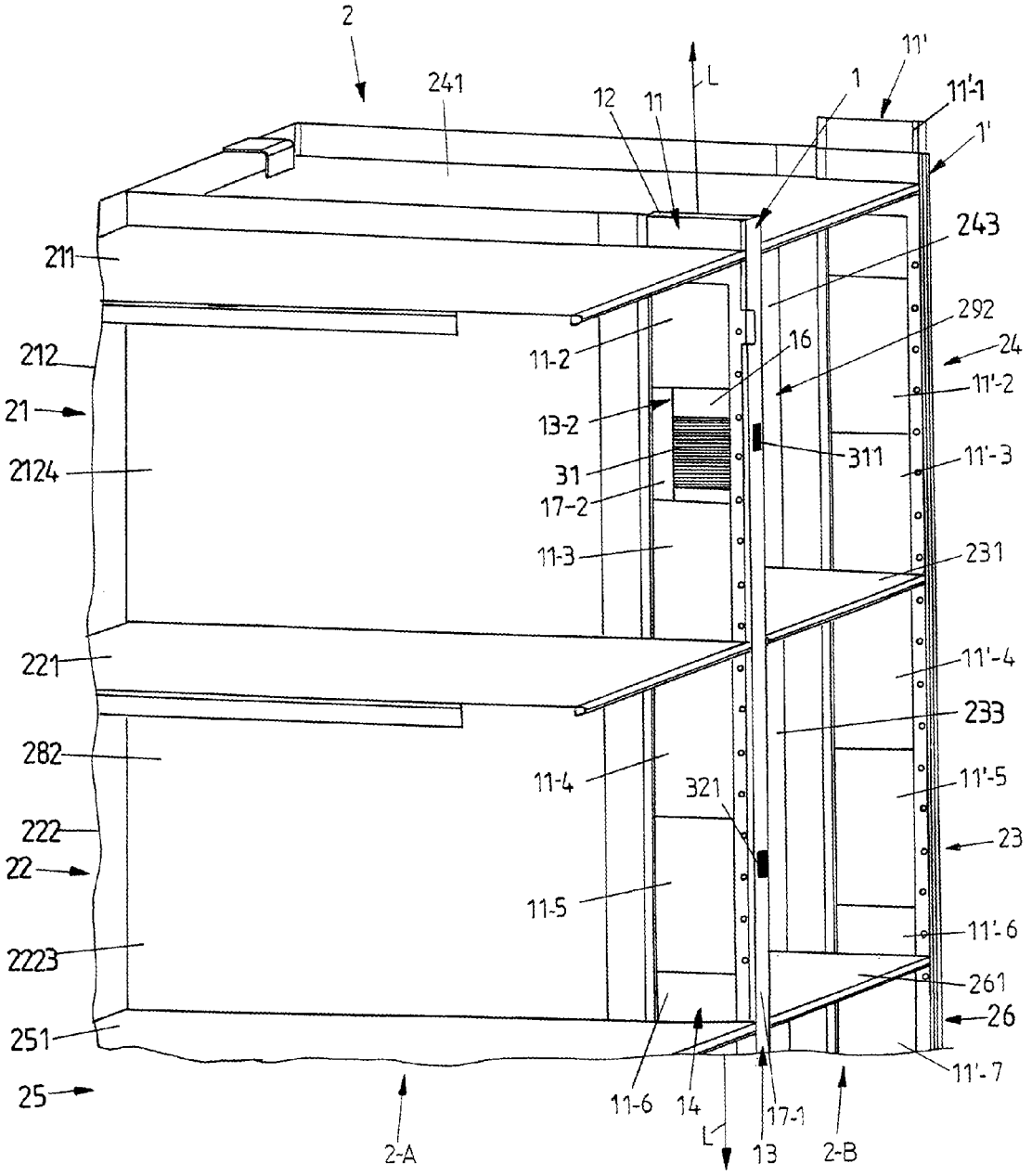
FIG. 3 illustrates a perspective and schematic view of the locker system, wherein the first lamella element and a second lamella element have been displaced.
Figure 4:
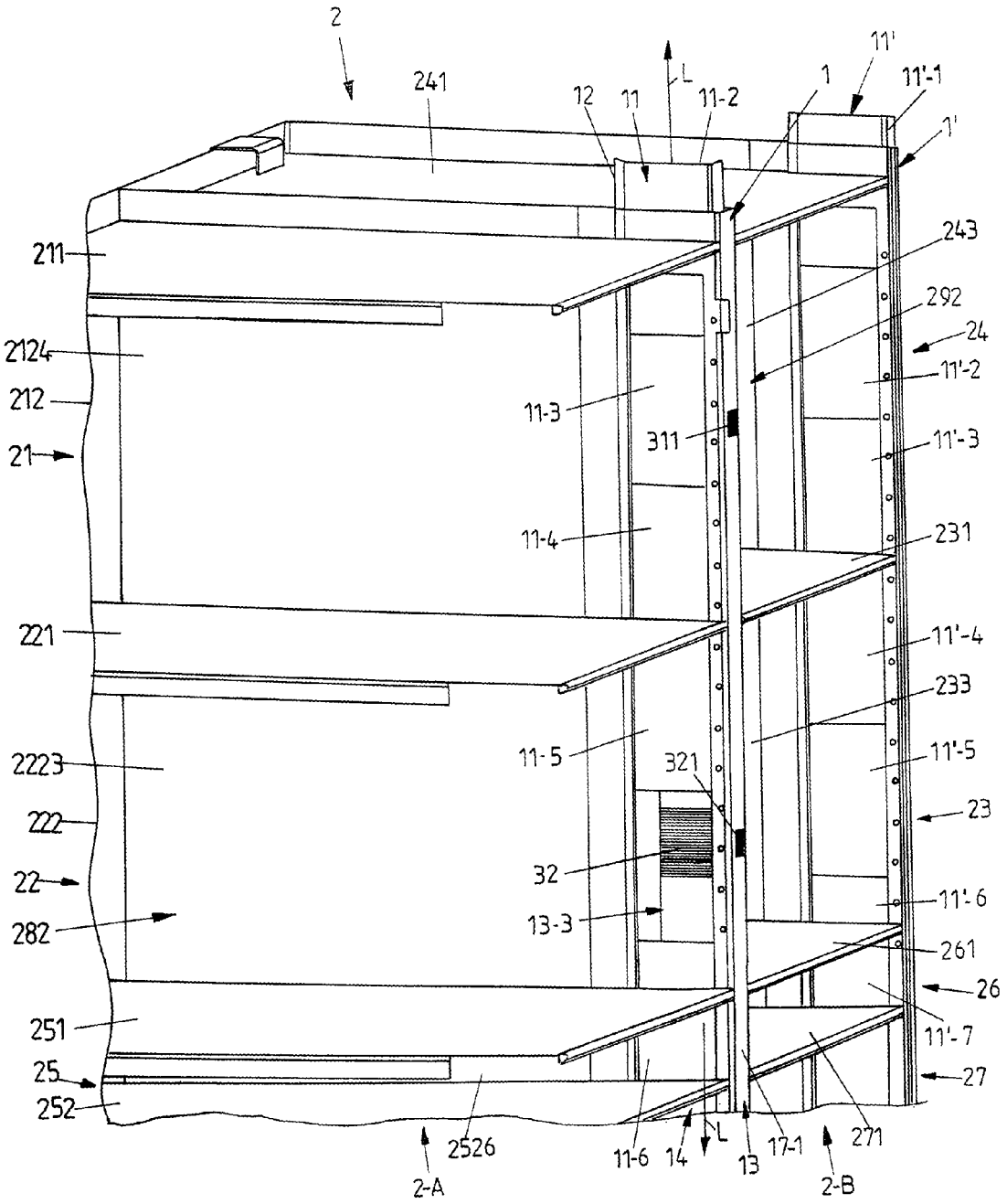
FIG. 4 illustrates a perspective and schematic view of the locker system, wherein a plurality of lamella elements have been displaced.
Figure 5:
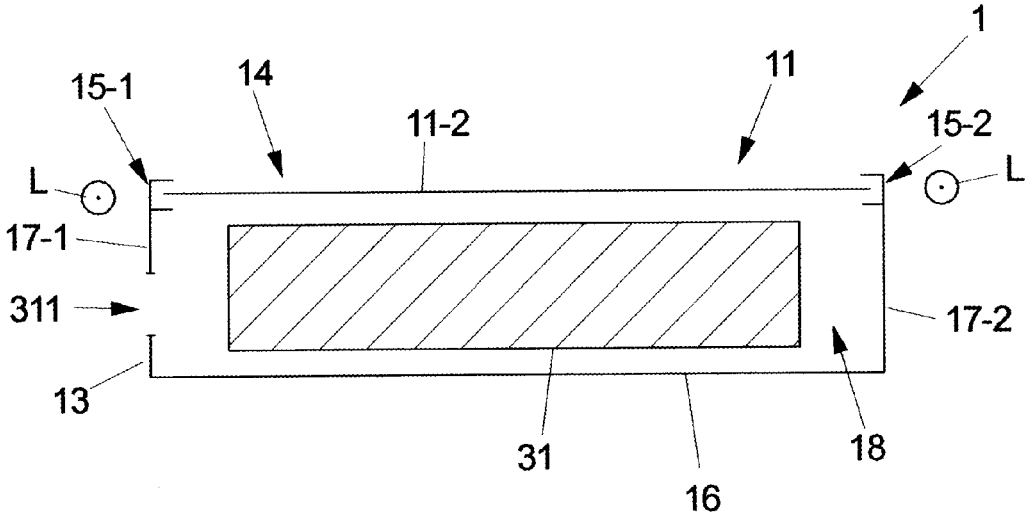
FIG. 5 illustrates a schematic cross-sectional view of an exemplary profile rail.

In FIG. 1, the lamella elements 11-1 to 11-6 and 11-1 to 11'-7 have not been displaced, but in FIG. 2, only the lamella element 11-1 has been displaced, while in FIG. 3, the lamella elements 11-1 and 11-2 have been displaced, and in FIG. 4, the lamella elements 11-1 to 11-5 have been displaced. FIG. 5 illustrates the profile rail 1 in a cross-sectional view. In all of the drawings, the lamella elements 11'-1 to 11'-7 of the profile rail 1' are not displaced.

The following refers to all of FIGS. 1 to 5.

The locker system 2 is, for example, a packing station for temporary storage of shipping goods. The locker system 2 comprises a plurality of lockers 21, 22, 23, 24, 25, 26, and 27. The lockers 25 and 26 can only be seen in FIGS. 3 and 4, and the locker 27 can only be seen in FIG. 4.

The locker 21 is delimited by a ceiling element 211, a rear wall element 212, a ceiling element 221, and a side wall element 2124. The drawings do not depict an opposing side wall element nor a locker door.

The same applies, mutatis mutandis, to the other lockers 22 to 27. Thus, for example, the locker 22 is delimited by the ceiling element 221, a rear wall element 222, a side wall element 2223, and another ceiling element 251. The locker 24 is delimited by a ceiling element 241, a side wall element 243, and a ceiling element 231; the locker 23 is delimited by the ceiling element 231, a side wall element 233, and by the side wall element 2223 as well as another ceiling element 261, etc.

The two ceiling elements 211 and 241 may form an integrated locker roof, and need not necessarily be elements that are separated from one another. The same applies, mutatis mutandis, to the rear wall elements 212, 222, and 252, which may form, for example, an integrated rear wall of the locker system 2 and need not be configured as components that are separate from one another. This also applies to the side wall elements 2124, 2223, 2526, 243 and 233; for example, both side wall elements 2124, 2223, and 2526 are part of a first side wall 282, and the side wall elements 243 and 233 are part of a second side wall 292.

The profile rail 1 constitutes another part of the first side wall 282, and the profile rail 1' constitutes another part of the second side wall 292. A side cover 14 of the profile rail 1 points to the inner spaces of the lockers 21, 22, and 25, and a rear side 16 of the profile rail 1 (see FIG. 5) points to the inner spaces of the lockers 24, 23, 26, and 27. The side cover 14 of the profile rail is provided by the lamella device 11, as shall be described in greater detail below.

The first side wall 282, which includes the profile rail 1, thus delimits a first region 2-A of the locker system 2 from a second region 2-B of the locker system 2. The lockers 21, 22, and 25 are arranged one above the other in the first region 2-A. These lockers shall also be referred to as first lockers 21, 22, and 25 below. In the second region 2-B of the locker system 2, the lockers 24, 23, 26, and 27 are arranged one above the other; these lockers shall also be referred to as second lockers 24, 23, and 26 below.

A first locking mechanism 31 (see FIG. 3) is assigned to the second locker 24, and a second locking mechanism 32 (see FIG. 4) is assigned to the second locker 23. The first locking mechanism 31 and the second locking mechanism 32 are both integrated within the profile rail 1, as shall be described in greater detail with reference to FIG. 5.

The profile rail 1 comprises a substantially U-shaped cross-section, which is defined by two profile legs 17-1 and 17-2 and by the rear side 16 of the profile rail 1. The two profile legs 17-1 and 17-2 and the rear side 16 of the profile rail 1 delimit an intervening space 18. Within this intervening space 18, the two locking mechanisms 31 and 32 are arranged, only the first locking mechanism 31 being outlined in the cross-sectional view illustrated in FIG. 5.

Complete coverage of the two locking mechanism 31 and 32 is provided by the lamella device 11. The lamella device 11 comprises the aforementioned lamella elements 11-1 to 11-6, which are arranged so as to be displaceable along the direction of the longitudinal extension L of the profile rail 1.

In order to displace the lamella elements 11-1 to 11-6 along the direction of the longitudinal extension L, guiding means in the form of guiding grooves 15-1 and 15-2 with which the lamella elements 11-1 to 11-6 engage are provided on the profile legs 17-1 and 17-2. Such a construction ensures that the lamella elements 11-1 to 11-6 of the lamella device 11 can be displaced only along the direction of the longitudinal extension L of the profile rail 1, and are not movable in any other direction. In particular, the lamella elements 11-1 to 11-6 cannot be removed laterally from the profile rail 1. The two locking mechanisms 31 and 32 are thereby integrated in a tamper-proof manner within the profile rail 1.

In the embodiments illustrated, the lamella elements 11-1 to 11-6 are formed in an approximately rectangular shape and a substantially planar fashion. However, the present invention is not limited to such a shape of the lamella elements 11-1 to 11-6. For example, the lamella elements 11-1 to 11-6 are formed so as to each be complementary to the profile rail 1, and each have an approximately U-shaped cross-section which can engage with the intervening space 18. In this variant, instead of the guide grooves 15-1 and 15-2, it would be possible for overhangs configured in parallel to the rear side 18 to be provided on the profile legs 17-1 and 17-2, the overhangs guiding the lamella elements 11-1 to 11-6 along the longitudinal extension of the profile rail 1 on the one hand, and preventing any different form of movement of the lamella elements 11-1 to 11-6 on the other hand.

The detailed design of the locking mechanisms 31 and 32 is presently less relevant. The locking mechanisms 31 and 32 need not be configured identically to one another. For example, the locking mechanisms 31 and 32 are each configured as locks.

To lock, for example, the second locker 24, a door (not shown in the drawings) is locked. With a swinging motion of the locker door, a bolt or other such locking element built into the locker door is inserted through a locking mechanism entrance 311 into the locking mechanism 31, in order to form a releasable locking there with the locking mechanism 31. The locking mechanism entrance 311 is formed, for example, of an opening provided on the profile leg 17-1, as shown schematically in FIG. 5. The profile leg 17-1 of the profile rail 1 forms at once a front side 13 of the profile rail 1. For the second locking mechanism 32, a second locking mechanism entrance 321 is provided at a corresponding location.

So long as service access to the locking mechanisms 31 and 32 is not needed, then none of the lamella elements 11-1 to 11-6 is displaced. Rather, the lamella elements 11-1 to 11-6 are readily arranged overlapping with one another, so as to create the substantially opening-free side cover 14. In addition, the lamella elements 11-1 to 11-6 are retained at a retaining site 12 of the profile rail against displacement in the direction of the longitudinal extension. Longitudinal displacement in the direction of the longitudinal extension L of the profile rail is consequently impossible. Such retention can be ensured by, for example, screwing the first lamella element 11-1 to the profile leg 17-2 at the retaining site 12. The state in which the lamella elements 11-1 to 11-6 are not displaced is illustrated in FIG. 1.

If the first locking mechanism 31 or the second locking mechanism 32 then needs to be serviced, then the retention at the retaining site 12 can be released and the first lamella element 11-1 can be displaced in the direction of the longitudinal extension L of the profile rail 1, as illustrated schematically in FIG. 2. The displacement of the first lamella element 11-1 creates a first opening 13-1, which offers a view of the rear side 16 of the profile rail 1. In order to gain access to the first locking mechanism 31, the second lamella element 11-2 now needs to be displaced. This is illustrated schematically in FIG. 3. Displacement of the second lamella element 11-2 forms a second opening 13-2, which permits access to the first locking mechanism 31. In this state, the first locking mechanism 31, which (as stated) is assigned to the second locker 24, can therefore be serviced or replaced from the interior of the first locker 21. After completion of the work, the lamella elements 11-1 and 11-2 can be displaced back in order to protect the locking mechanism 31 against attempts at tampering.

If the second locking mechanism 32 needs to be serviced or replaced, then all of the corresponding lamella elements 11-1 to 11-5 found thereabove must, corresponding to the foregoing, be displaced in the direction of the longitudinal extension L of the profile rail 1. This state is illustrated in FIG. 4. Displacement of these lamella elements 11-1 to 11-5 forms a third opening 13-3 that permits access to the second locking mechanism 32. Here, the access to the second locking mechanism 32, which is assigned to the second locker 23, takes place from the interior of the first locker 22.

In the embodiments described above, the access to the respective locking mechanism 31, 32 of a given locker takes place from a respective adjacent locker. It would also be possible, however, as has been explained in the general part of the description, for the locker system 2 to be conceived such that after the lamella elements 11-1 to 11-6 have been displaced, the access to the locking mechanism takes place from the interior of the locker to which the locking mechanism is also assigned. The locker system 2 can in principle implement both arrangement variants.

In any event, access to the locking mechanisms 31 and 32 is only possible if the lamella elements 11-1 to 11-6 of the lamella device 11 of the profile rail 1 are displaced. The lamella elements 11-1 to 11-5 are (apart from the first lamella element 11-1) preferably not screwed onto the profile rail 1. It would also not be possible to remove the lamella elements 11-1 to 11-6 laterally from the profile rail 1. Access to a locking mechanism without displacement of the lamella elements 11-1 to 11-6 would therefore require the destruction of a respective lamella element, which would generate a substantial expenditure for a third party. Therefore, the proposed solution is largely tamper-proof.

LIST OF REFERENCE SIGNS

1, 1' Profile rails
11, 11' Lamella devices
11-1, . . . , 11-6 Lamella elements of the lamella device 11
11'-1, . . . , 11'-7 Lamella elements of the lamella device 11'
12 Retaining site
13 Front side of the profile rail 1
13-1 First opening
13-2 Second opening
13-3 Third opening
14 Side cover of the profile rail 1
15-1, 15-2 Guide groove
16 Rear side of the profile rail 1
17-1, 17-2 Profile legs of the profile rail 1
18 Intervening space
L Direction of the longitudinal extension of the profile rail 1
2 Locker system
2-A First region of the locker system 2
2-B Second region of the locker system 2
21, 22, 25 First lockers
23, 24, 26, 27 Second lockers
211, 221, 231, 241, 251, 261, 271 Ceiling elements
212, 222, 252 Rear wall elements
2124, 2223, 2526, 233, 243 Side wall elements
282 First side wall
292 Second side wall
31, 32 Locking mechanisms
311, 321 Locking mechanism entrances

What is claimed is:

1. A profile rail (1) for forming a locker system (2) having a plurality of lockers (21, . . . , 27), each of the lockers (21, . . . , 27) being formed by a plurality of walls (212, 212, 221, 2124) and having an open front to permit access to the respective locker (21, . . . , 27), the profile (1) rail being adjacent the open front of at least first and second of the lockers (21, . . . , 27) that are adjacent one another, wherein the profile rail (1) comprises:

at least two profile legs (17-1, 17-2) with an intervening space (18) delimited by the at least two profile legs (17-1, 17-2);

a locking mechanism (31) in the intervening space (18) delimited by the at least two profile legs (17-1, 17-2); and a lamella device (11) to cover the locking mechanism (31), the lamella device (11) being arranged to be displaceable in a direction of a longitudinal extension (L) of the profile rail (1) to access the locking mechanism (31), and wherein the lamella device (11) can be retained at a retaining site (12) of the profile rail (1) against longitudinal displacement.

2. The profile rail (1) of claim 1, wherein the lamella device (11) comprises a plurality of lamella elements (11-1, . . . , 11-6) arranged so as to be displaceable in the direction of the longitudinal extension (L) of the profile rail (1), the plurality of lamella elements (11-1, 11-6) being configured for an at least partially mutually overlapping arrangement, to create a substantially opening-free side cover (14) of the profile rail (1).

3. The profile rail (1) of claim 1, wherein the profile rail (1) has a substantially U-shaped cross-section.

4. The profile rail (1) of claim 1, wherein one of the at least two profile legs (17-1) comprises at least one opening for forming a locking mechanism entrance (311), so that a bolt can be inserted through the at least one locking mechanism entrance (311) into the locking mechanism (31) to form locking with the locking mechanism (31).

5. The profile rail (1) of claim 1, wherein the profile rail (1) comprises a guide groove (15-1, 15-2) for guiding the lamella device (11) along the longitudinal extension (L) of the profile rail (1).

6. The profile rail (1) of claim 1, wherein the lamella device (11) is displaceable only along the longitudinal extension (L) of the profile rail (1) and is not removable in another direction from the profile rail (1).

7. The profile rail (1) of claim 1, wherein the retaining site (12) of the profile rail (1) is arranged outside of the lockers (21, 26).

8. A locker system (2) having a plurality of lockers (21, . . . , 26), and at least one profile rail (1, $\mathbf{1}^1$) according to claim 1.

9. A profile rail (1) for forming a locker system (2) having a plurality of lockers (21, . . . , 27), the profile rail (1) forming a part of a side wall (282) of the locker system (2), the side wall (282) subdividing the locker system (2) into a first region (2-A) and a second region (2-B), the first region (2-A) comprising at least one first locker (21) and the second region (2-B) comprising at least one second locker (24), that is arranged horizontally adjacent to the at least one first locker (21), the profile rail (1) being formed to integrate a locking mechanism (31) of one of the lockers (21) within the profile rail (1), wherein the profile rail (1) comprises: a lamella device (11) to cover the integrated locking mechanism (31), the lamella device (11) being arranged to be displaceable in a direction of a longitudinal extension (L) of the profile rail (1), and wherein the lamella device (11) can be retained at a retaining site (12) of the profile rail (1) against longitudinal displacement.

10. The profile rail (1) of claim 9, wherein the profile rail (1) comprises at least two profile legs (17-1, 17-2) to integrate the locking mechanism (31) in an intervening space (18) delimited by the at least two profile legs (17-1, 17-2).

11. The profile rail (1) of claim 9, wherein the integrated locking mechanism (31) is assigned to the at least one second locker (24), a substantially opening-free rear side (16) of the profile rail (1) points to an inner space of this second locker (24), and the lamella device (11) of the profile rail (1) points to an inner space of the first locker (21).

12. A locker system (2) for forming a locker system (2) having a plurality of lockers (21, . . . , 27), and at least one profile rail (1), the profile rail (1) being formed to integrate a locking mechanism (31) of one of the lockers (21) within the profile rail (1), wherein the profile rail (1) comprises: a lamella device (11) to cover the integrated locking mechanism (31), the lamella device (11) being arranged to be displaceable in a direction of a longitudinal extension (L) of the profile rail (1), and wherein the lamella device (11) can be retained at a retaining site (12) of the profile rail (1) against longitudinal displacement, wherein a side wall (282) of the locker system (2) sub-divides the locker system (2) into a first region (2-A) and a second region (2-B), and wherein the first region (2-A) comprises at least one first locker (21) and the second region (2-B) comprises at least one second locker (24), that is arranged horizontally adjacent to the at least one first locker (21), and the profile rail (1) forming a part of the side wall (282).

13. The locker system (2) of claim 12, wherein the locking mechanism (31) integrated into the profile rail (1) is assigned to the at least one second locker (24), a substantially opening-free rear side (16) of the profile rail (1) points to an inner space of this second locker (24), and the lamella device (11) of the profile rail (1) points to an inner space of the at least one first locker (21).

14. The locker system (2) of claim 12, wherein the locking mechanism (31) integrated into the profile rail (1) is assigned to the at least one first locker (21), a substantially opening-free rear side (16) of the profile rail (1) points to an inner space of the at least one second locker (24), and the lamella device (11) of the profile rail (1) points to an inner space of the at least one first locker (24).

* * * * *